US007753547B2

(12) United States Patent
Waters

(10) Patent No.: US 7,753,547 B2
(45) Date of Patent: Jul. 13, 2010

(54) LIGHTED HEADWEAR WITH BRIM SLEEVE

(76) Inventor: Michael Waters, 213 W. Main St., West Dundee, IL (US) 60118

( * ) Notice: Subject to any disclaimer, the term of this patent is extended or adjusted under 35 U.S.C. 154(b) by 0 days.

(21) Appl. No.: 12/363,130

(22) Filed: Jan. 30, 2009

(65) Prior Publication Data

US 2009/0193566 A1 Aug. 6, 2009

Related U.S. Application Data

(63) Continuation of application No. PCT/US2008/087542, filed on Dec. 18, 2008.

(60) Provisional application No. 61/014,726, filed on Dec. 18, 2007.

(51) Int. Cl.
*F21V 21/084* (2006.01)

(52) U.S. Cl. ..... 362/106; 362/105; 362/376; 2/209.13; 200/304

(58) Field of Classification Search ..... 362/105, 362/106, 376; 40/329; 2/209.13; 200/304
See application file for complete search history.

(56) References Cited

U.S. PATENT DOCUMENTS 5,718,335 A 2/1998 Boudreaux
5,845,778 A 12/1998 Hickey, Jr.
5,865,333 A 2/1999 Wolfe
6,311,837 B1 11/2001 Blaustein et al.
6,431,904 B1 8/2002 Berelsman
6,721,962 B1 * 4/2004 Polaire ..... 2/209.13
6,733,150 B1 5/2004 Hanley
6,811,441 B2 11/2004 Simpson
6,923,322 B2 8/2005 Lenker
6,932,216 B2 8/2005 Blaustein et al.
6,993,803 B2 2/2006 Chan
7,094,981 B2 8/2006 Sorrentino et al.
7,163,309 B2 * 1/2007 Sohn ..... 362/106
2005/0211574 A1 9/2005 Reeve
2006/0141828 A1 6/2006 Dean et al.

OTHER PUBLICATIONS

International Search Report and Written Opinion of the International Searching Authority for International Application No. PCT/US2008/087542 dated May 4, 2009, 12 pages.

* cited by examiner

*Primary Examiner*—Stephen F Husar
(74) *Attorney, Agent, or Firm*—Fitch, Even, Tabin & Flannery

(57) ABSTRACT

There is provided hands-free lighting, components thereof, and other accessories combined with the hands-free lighting. The hands-free lighting is preferably lighted headgear including hats and includes various accessories for use therewith, such as a protective switch guard associated with hat packaging surrounding an activation switch to prevent inadvertent activation while still allowing intentional actuation thereof.

16 Claims, 3 Drawing Sheets

LIGHTED HEADWEAR WITH BRIM SLEEVE

CROSS-REFERENCE TO RELATED APPLICATIONS

This application is a continuation of International Application Number PCT/US08/87542, filed Dec. 18, 2008, which claims benefit of U.S. Provisional Application No. 61/014,726, filed Dec. 18, 2007, which are hereby incorporated herein by reference in their entirety.

FIELD OF THE INVENTION

The field relates to hands-free lighting devices and, in particular, to lighted hats and protective guarding that may be mounted to the hat for protection against unintended activation of the lighting device.

BACKGROUND OF THE INVENTION

Often an individual desires a light focused to illuminate an area while performing a task or a light directed in a general outward direction for visibility. Holding a flashlight is an option, but such lighting devices are often cumbersome and may detract from the task being completed because the flashlight needs to be hand-held to be able to direct the light at a work site where the user needs illumination. As a result, hands-free lighting is often used because the individual desiring illumination does not need to hold the light source.

Lighted headgear may include illumination sources mounted to various types of headgear and hats. The light can be directed in such a manner so that the wearer is illuminated to be seen by others or directed downward to provide light forwardly of the wearer illuminating an area in the wearer's field of view, such as for reading. Applicant's U.S. Pat. No. 6,659,618 provides examples of such lighted hats. The light source can be one or more LEDs. Such LED lighted headgear, which may include LEDs mounted to a typical baseball-style cap, are convenient for hands-free lighting in a number of recreational activities, such as camping, hunting, fishing, jogging, or the like. Lighted headgear may include separate components such as one housing or assembly to hold a power source and other electrical components and a separate housing or assembly to contain the illumination source. Other lighted hats may contain all electrical components within a crown and/or brim portion of the hat. In each case, the lighted headgear generally includes a user-activated power switch (to energize the light source) positioned on one of the housings or on a portion of the hat.

In many cases, the lighted headgear is displayed on a store shelf in a manner so that a potential purchaser can operate the switch to turn on the light source. To this end, the hat may be provided to the store with a power source already included so that the light source can be activated by the consumer. However, because the lighted headgear may be shipped in bulk to the store with the power source included, the power source can be unintentionally activated through contact of the activation switch with an adjacently packed hat. In particular, where the activation switch is positioned on the hat brim, the light source can be inadvertently turned on during the shipping process by the hat brim of one hat engaging or depressing the activation switch of another hat nested therewith. Such inadvertent activation can drain the power source prior to the hat's display on the store shelf.

Prior packaging arrangements have been configured to allow actuation of a switch to momentarily activate a power source while an item is encased with the packaging, but such prior packaging is generally a blister-type pack that completely encases the product so that it tends to be bulky and distracts from the appearance of the item within the package. Moreover, such prior blister-pack arrangements generally do not include sufficient structure on the packaging to block inadvertent actuation of the switch that might cause power to drain from the battery. Therefore, when these prior packaging designs are shipped in bulk, there is the risk that engagement between adjacent packages could energize the power source and drain the battery.

For example, U.S. Pat. No. 6,311,837 to Blaustein provides a bulky blister pak for an electric toothbrush that allows momentary activation of the toothbrush while within the packaging material by permitting a power switch to be depressed momentarily, but attempts to block continuous actuation of the power source by hindering the sliding of the switch to a permanently on position. To this end, Blaustein permits the momentary depressing of its power switch by relying on the flexibility of the blister pak material covering the switch that can easily deform to allow the switch to be depressed, but then includes a single and narrow rib adjacent one side of the momentary switch to prevent the sliding action of the switch to the continuously on position.

Blaustein's single rib is designed primarily to block the activation switch from shifting or sliding in a direction along the shaft of the toothbrush to prevent the switch from being shifted to the continuous on position. Although this packaging arrangement may be effective to prevent the switch from being slid to the continuously on-position, the blister pak has a relatively flexible material surrounding the switch in order to permit the momentary actuation of the switch. Therefore, inadvertent actuation may still occur when multiple items having this packaging arrangement are stacked atop one another. When sufficient items are tightly packed in a box or other shipping crate, a force between packed items may be sufficient to deform of the thin blister pak material covering the switch to depress the switch to the momentary on position. Therefore, Blaustein's switch can be inadvertently depressed to the momentary on position and the power source drained.

Lighted headgear may include activation switches that are operable to establish electrical communication between the power source and the illumination source. The illumination source can be energized once the activation switch is depressed, slid, or otherwise shifted to an on position. For example, it is known to place a push button switch underneath the fabric covering the rigid brim material. However, many activation switches tend to be large and bulky and they do not allow the hat to maintain its normal more desired appearance because the switch provides bulges or other bumps in the profile of the hat.

SUMMARY OF THE INVENTION

There is provided lighted headgear with a removable brim sleeve that may be mounted to a brim portion of the lighted headgear so as to provide protection against inadvertent actuation of a light switch associated with the lighted headgear. Preferably, the brim sleeve will include a thin cardboard, paperboard, or other fiberboard packaging cover or body capable of being detachably mounted to a brim of the lighted headgear. An upper portion of the brim sleeve body is configured to extend across and substantially cover a top portion of the lighted hat brim and is connected to at least one lower portion of the brim sleeve body, which is configured to extend along a bottom surface of the lighted hat brim between opposite brim side edges thereof. Such a configuration provides a packaging cover that forms a sleeve about the brim that generally conforms to the upper and lower brim surfaces so as to maintain a thin profile having a curvature similar to that of the brim surfaces. This configuration of the brim sleeve provides a packaging surface for indicia or other cap identification, but is not bulky and generally does not distract from the hat's appearance because it configured to conform to the curvature of the upper and lower brim surfaces. In addition, such compact and conforming configuration of the brim sleeve relative to the hat brim also enables a consumer to try on the hat in the store because the brim sleeve does not interfere with the crown or other head wrapping portion of the hat.

The lighted headgear also includes an actuation switch used to actuate the light source on the lighted headgear. The actuation switch may include a variety of forms and be positioned in a variety of locations on the hat. In one example, the actuation switch is disposed on the lower brim surface and has a button or plunger actuator extending away from the brim surface that is configured to be depressable toward the brim such that the light source may be actuated to an "on" or "off" state by depressing the button or plunger actuator towards the brim. A user may depress the button or plunger actuator to actuate the lighted headgear to its on-state, which may include a number of alternative lighting modes (blinking, colors, varying number of light sources energized, etc.) selected by repeatedly depressing the button to select the modes of the on-state. The light source will remain in the on-state (or selected lighting mode) until the user again depresses the plunger actuator causing the switch to configure the lighted headgear to an off-state.

The brim sleeve may also include a protection or switch guard adjacent to or extending around the actuation switch. For example, at least one lower portion of the brim sleeve body may have the switch guard associated therewith that is configured to extend about the actuation switch so as to avoid inadvertent actuation thereof. The switch guard may be a portion of the cardboard body or be a separate plastic piece mounted to the cardboard or paperboard portion of the brim sleeve via a mounting flange and a mating surface. In a preferred form, the switch guard is a molded plastic material having an upstanding flange or wall portion that, when mounted to the hat brim, extends away from the brim surface beyond the plunger actuator to serve as a barrier for avoiding unintentional actuation of the actuation switch. The upstanding flange or wall portion may generally encircle the activation switch, but still has an access opening associated with the button or plunger actuator thereby providing direct and intentional access to the switch.

Many lighted hats may be manufactured at the same facility and transported from the facility to a retail store for consumer purchasing in a shipping box or other crate. A convenient way to transport such lighted hats is to place a plurality of lighted hats in a nested configuration where the individual hats within the plurality of lighted hats stack atop one another such that a crown of a lower lighted hat is inserted into a crown of an upper lighted hat while a brim of the lower lighted hat overlaps at least a portion of a brim of the upper lighted hat. This nested configuration allows for convenient and efficient transportation of the plurality of lighted hats. In order to prevent inadvertent actuation of an activation switch associated with any of the individual hats within the plurality of lighted hats, an insert spacer device is provided that is positioned between the nested brims of adjacent hats. For example, the insert spacer device may be positioned between the brim upper surface of the lower hat and the brim lower surface of the upper hat. The spacer device is then arranged and configured to maintain a space between the two hat brims so that the switch on the lower surface of the upper hat remains spaced from the upper brim surface of the lower hat when the hats are in a nested arrangement.

In one form, the insert spacer device may include the above described brim sleeve and switch guard to prevent the inadvertent actuation of the corresponding activation switches associated with each of the individual hats when in the nested arrangement. In particular, each hat will include an associated brim sleeve surrounding its brim with the associated switch guard extending about its activation switch. These switch guards will also preferably have an upstanding flange or wall portion that encircles the activation switch to avoid inadvertent actuation of the activation switch by any of the other individual hats within the plurality of lighted hats in the nested configuration.

DETAILED DESCRIPTION OF THE PREFERRED EMBODIMENT

Figure 1:
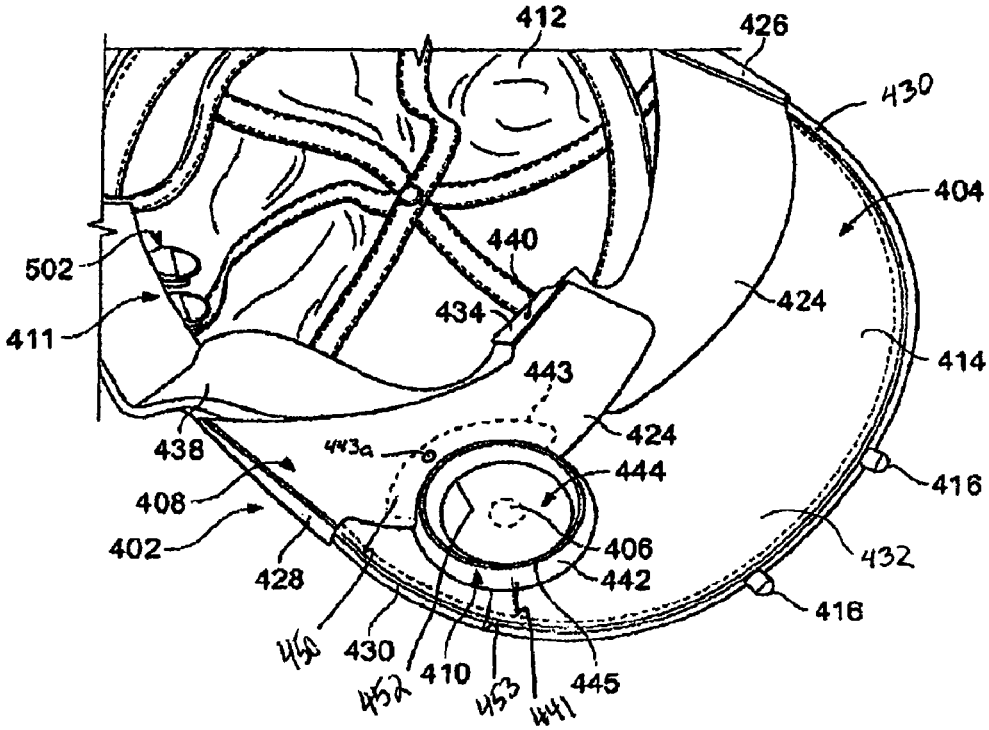
FIG. 1 is a bottom plan view of a lighted baseball hat showing packaging material that includes a protective guard for an activation switch.

In general, the various aspects of the disclosure herein relate to hands-free lighting, components thereof, and other accessories therefor combined with the hands-free lighting. As further described below, the hands-free lighting may include lighted headgear such as hats, including baseball caps, hoods, and other lighted clothing items having the lights positioned thereon to provide lighting forwardly of the wearer. A hands-free lighting accessory associated with the lighted headgear is removable packaging materials with a protective guard that limits inadvertent actuation of a switch to energize the lights of the lighted headgear. The packaging materials may be configured to conform to the lighted headgear in a streamlined manner.

Referring to FIGS. 1-5, a guarding or covering device 402 preferably in the form of a brim sleeve is illustrated for use in combination with a lighted hat 404 for providing a packaging cover for the hat and for providing a barrier to hinder or prevent inadvertent activation of a power switch 406 on the lighted hat 404. The brim sleeve 402 is advantageous because it provides both a packaging cover for the hat to provide information about the hat and, at the same time, protects against unintended power source activation, which enables a power source or other battery to be installed in the hat during manufacture so that the hat can be shipped to a retail store without the risk of the installed power source being inadvertently drained.

In general, the brim sleeve 402 is provided with a detachable covering 408, which is detachably securable to the hat 404, and a barrier wall or shielding member/portion 410 for protection against accidental actuation of the switch 406. The shield portion 410 protects the switch 406 from unintended actuation but, at the same time, still permits direct and intentional actuation of the switch 406 by a potential purchaser or other user. That is, the shield member 410 is configured as a protective barrier that is adjacent to and, preferably partially or completely surrounding the switch 406 so that an adjacent surface (such as a table, wall, or other nested hat 404*a* shown in FIG. 3) will not cause the switch 406 to be inadvertently depressed because the shield 410 keeps the adjacent surface spaced a predetermined distance from the switch 406 and, thus, restricts the adjacent surface from contacting the activation switch 406. At the same time, the shield member 410 also has an access opening sized to provide direct and intentional access to the switch 406 by the user for intentional actuation. In this manner, the hat 404 can be shipped to a store having a power source 411 installed without the risk of the unintentional activation of the power switch when the hat is contacted by an adjacent surface (such as with multiple hats nested together) that could drain the battery prior to the store shelf. At the same time, the shielding member 410 also permits the activation switch 406 to be intentionally activated through the access opening to allow a consumer to test the hat while it is on the store's display shelf.

Figure 4:
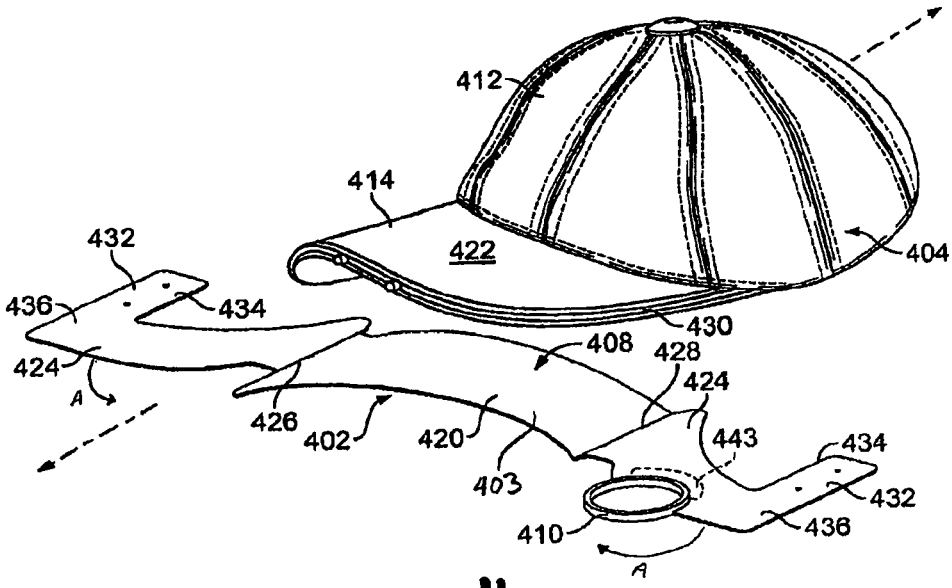
FIG. 4 is a perspective view of the lighted baseball hat showing the packaging material including the protective guard in an unwrapped configuration.
Figure 5:
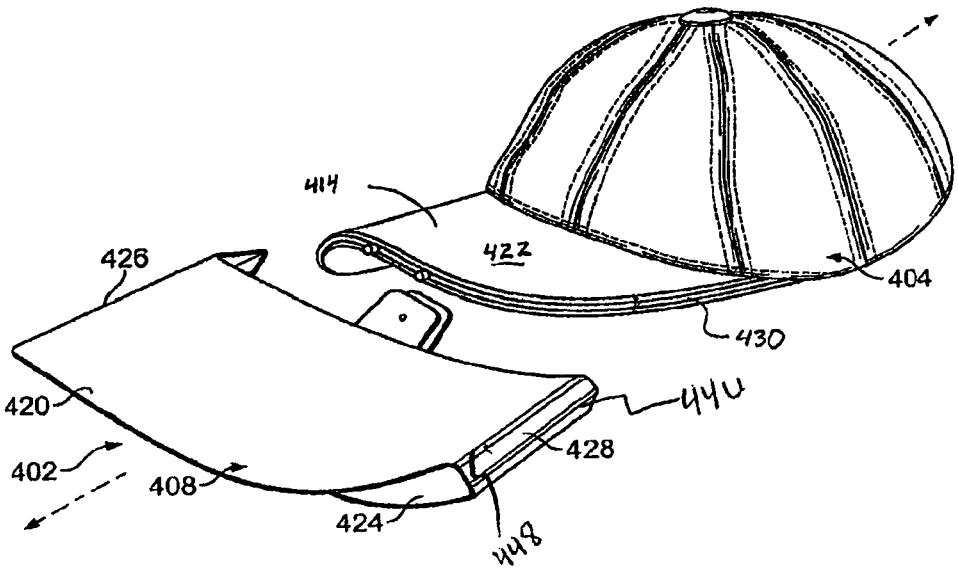
FIG. 5 is a perspective view of the lighted baseball hat showing the packaging material including the protective guard in a wrapped, sleeve configuration.

As shown in the drawings, the hat 404 may be a traditional baseball style hat having a crown portion 412 and a brim portion 414 extending from a forward, lower edge of the crown portion 412 as shown in FIGS. 1, 4, and 5. The hat 404 also preferably includes one or more illumination sources 416, which can be any of the previously described light sources herein or described in related U.S. application Ser. No. 11/941,558, which is incorporated herein in its entirety. While the guarding device 402 is particularly useful in a configuration designed for the baseball-style hat, it will be appreciated that the guarding device 402 may also be configured for other types of headgear in a similar fashion. In addition, while the shielding member/portion 410 of the guarding device 402 is preferably intended to avoid unintended activation of the illumination sources 416, the shielding member 410 may also be used to prevent inadvertent actuation of other switches configured to operate additional accessories mounted to headgear, such as cameras, speakers, radios, MP3 players to suggest a few examples.

Figure 3:
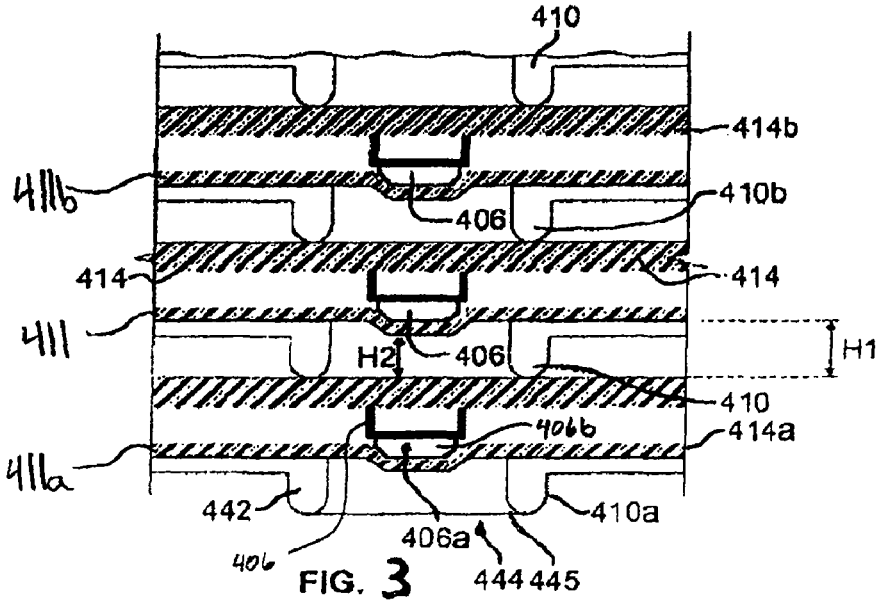
FIG. 3 is a cross-sectional view of the brims of a plurality of nested hats showing the protective guards keeping the adjacent brims spaced to avoid accidentally actuating the brim switches.

In one form, the shielding member/portion 410 of the guarding device may be particularly effective in preventing the inadvertent actuation of an illumination activation switch 406 having a depressable button or plunger actuator 406*a* for actuating the illumination source as generally shown in FIG. 3. The plunger actuator 406*a* of the switch 406 includes an outer button 406*b* that extends away from the brim and is depressable towards the brim to energize the light source on the lighted hat between an "on" or "off" state. To this end, if the button is depressed a first time, the light on the lighted hat is energized to its "on" state where the light will remain continuously in the on-state until the user again depresses the button or plunger a second time causing the switch to configure the lighted hat to its "off" state. As described more below, the shield member/portion 410 effectively prevents inadvertent actuation of the lighted hat by surrounding the activation switch and plunger thereof and extends farther beyond the surface of the hat than the plunger actuator. This additional distance the shield extends past the plunger is effective at preventing inadvertent depressing of the button or plunger actuator because the shield blocks or hinders access to the plunger actuator.

Turning to more of the details, the detachable covering 408 of the guarding device 402 effectively forms a sleeve that encircles the hat brim and includes a thin cardboard or paperboard body 403 (FIG. 4) having a top or major surface portion 420 configured to conform to an upper curvature of a top surface 422 of the hat brim 414 and is sized to extend across the top surface 422 of the brim 414 (FIG. 4). The brim sleeve body 403 also includes a pair of flap arms or side portions 424 extending from opposite side ends 426 and 428 of the body top portion 420. The flap arms or side portions 424 are configured so as to fold under the top portion 420 as generally illustrated in FIGS. 1 and 5 (see Arrows A in FIG. 4). Preferably, the flaps 424 have a length sufficient so that they overlap each other when in the folded configuration under the hat brim as best shown in FIG. 1. In this manner, when mounted to the hat 404, the brim sleeve top portion 420 extends across the upper surface 422 of the hat brim 414, and the brim sleeve arm side portions 426 are configured to fold under the brim 414 at the brim edge 430 and extend across a lower surface 432 of the hat brim 414 as best shown in FIG. 1. To this end, the packaging cover body 408 may include various folds, creases, or bends as needed to permit the arm flaps 242 to easily bend or fold around the brim edges 430.

The opposite side ends 426 and 428 of the brim sleeve are generally of the same thickness as the hat brim 414 (FIG. 5) and connect/extend between the brim sleeve top portion 420 and the flap arms or side portions 424 such that the detachable covering 408 may maintain a profile similar to the hat brim 414 when mounted thereto. To this end, the opposite side ends 426 and 428 each may have a lower edge 446 and an upper edge 448 (FIG. 5), which connect between the side portion 424 and the top portion 420, respectively. Both the lower edge 446 and the upper edge 448 may contain score lines, folds, creases, perforations or other indents therealong that facilitate bending of the cardboard or paperboard material of the brim sleeve body 403, which allow the opposite side ends 426 and 428 to maintain a similar profile and thickness as the brim edge 430.

Each of the flaps 424 permits the covering 408 to be detachably mounted to the hat 404. By one approach, each flap 424 also includes a fastening member 432 in the form of a rearwardly extending strip 434 located adjacent the distal ends 436 of the flaps 424 (FIG. 1 and FIG. 4). As best shown in FIG. 1, each of the strips 434 are configured to overlap each other and be wrapped or folded into a headband material 438 formed within the hat crown 412. The strips 434 are either inserted in the headband and/or fastened thereto via a fastener 440, such as a staple, pin, snap, strap, adhesive and the like extending through both strips 434 and the fabric material forming the headband. By overlapping the strips 434 and fastening them to the headband 438, the guarding device 402 can be removably mounted to the brim 414 because the guarding device 402 can be removed from the hat simply by removing the fastener 440 and unfolding the strips 434 and flaps 424 from around the brim 414. In this manner, the covering 408 and guarding device 402 thereof can be secured to the hat 404 without detracting from the hat's appearance by forming a sleeve encasing the hat's brim only. To this end, by securing the covering 408 to the hat as provided herein, the hat can be tried on by a consumer in the store because the brim sleeve 402 conforms to the hat's profile and does not hinder or block the hat's crown portion 412.

The body 403 of the brim sleeve 402 is preferably a paper, cardboard, fiberboard, laminate or other conformable packaging-type material that is sufficiently flexible and can be folded at the ends 426 and 428 rending it capable of conforming to the curvature of the hat brim 414. To this end, the covering 408 may include score lines, folds, creases, perforations or other indents 448, 446 to permit easier folding and to define intersections between the adjacent cover sections. The top surface 420 of the detachable covering 408 may also include a decorative outer layer to be used for various markings and other indicia such as labels, logos, and other instructions so that the brim sleeve 402 also functions as a product identifier or marketing label. For instance, the top surface may indicate that the light source may be tested by suggesting the hat includes a "try me feature".

The shield member or portion 410 of the brim sleeve may be a portion of the paperboard body or, preferably, include a separate structure formed from a molded plastic that is attached to a portion of the paperboard body 403 of the brim sleeve. By one approach, the shield member 410 includes a wall 442 formed from upstanding flanges 441 (FIGS. 1 and 2) that can be positioned adjacent to and, preferably, partially or completely surround the hat switch 406. At the same time, the upstanding flanges 441 of the wall 442 also form a switch access opening 444 on a distal end 445 of the wall 442 to provide an opening for direct and intentional access to the switch 406 as generally illustrated in FIGS. 1 and 3. To this end, the plunger actuator 406*a* of the switch 406 is not covered by either the material forming the body 403 of the brim sleeve 402 or the plastic of the shield member 410, but still has the upstanding flange 441 of the wall 442 adjacent thereto to act as a barrier to prevent inadvertent actuation of the switch 406. Preferably, the shield 410 is formed from a plastic material and molded into the preferred annular shape. However, while the shield 410 is illustrated in the drawings as having an annular configuration, it will be appreciated that the guard 410 may be any shape so that as it is adjacent to and/or surrounds the switch and is capable of preventing unintended activation of the switch.

In one form, the shield wall 442 is formed from the upstanding flanges 441 and, in particular, a pair of upstanding flanges that form an annular structure arranged and configured to encircle the switch 406 when mounted to the hat. Turning again to FIG. 2, the wall 442 includes the pair of upstanding wall flanges 454 and 456 generally extending toward each other to form a tapered wall configuration where the base of the wall 442 has a wider width than a distal end of the wall. The tapered configuration includes an outer wall flange 454 and an inner wall flange 456 that are on either side of the access opening 444 of the shielding member 410. This tapered configuration is advantageous because it provides enhanced strength to the shield wall 442.

When the shield 410 is a separate piece from the paperboard body of the detachable covering 408, it also includes a mounting flange 443 thereof so that it can be mounted by a fastener 443*a* (such as staples, pins, adhesive, and the like) to a corresponding mating surface 450 located on one of the brim sleeve body flaps 424 in a position so that when the body 403 is mounted to the brim 414 as described above, the wall 442 of the shield member 410 surrounds the brim mounted switch 406 as best illustrated in FIG. 1. To this end, the mounting flange 443 preferably extends generally orthogonal or approximately transverse to the wall 442 and extends from one side of the shield 410 as best shown in FIG. 1. This permits the shield 410 to extend away from one edge of the brim sleeve flap arms 424.

Figure 2:
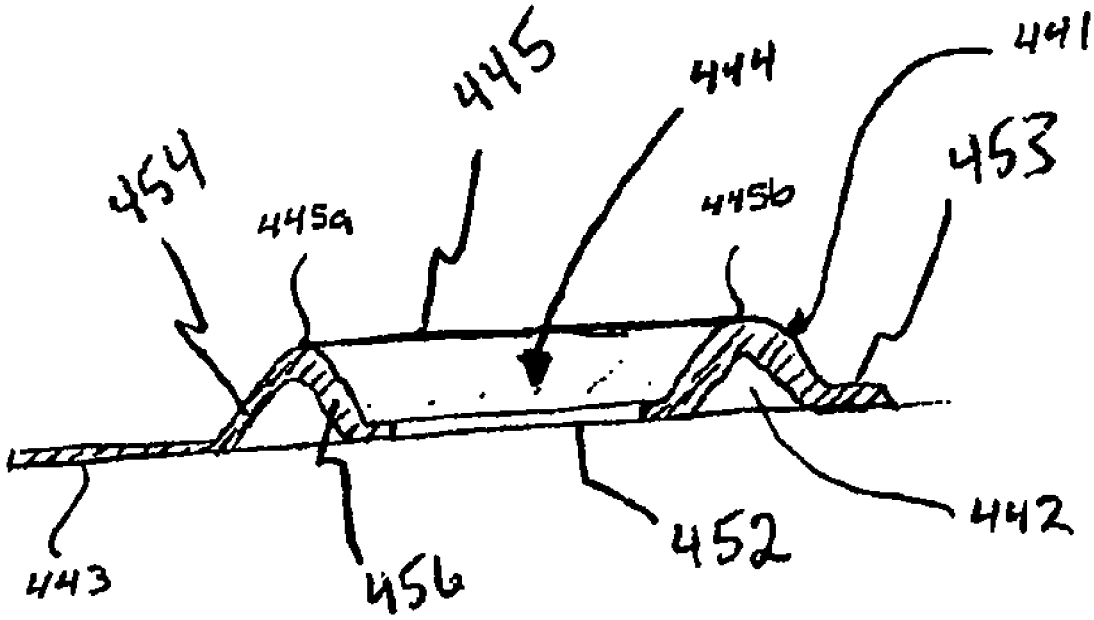
FIG. 2 is a cross-sectional view of a wall portion of the protective guard of the packaging material having an inner and outer flange portion configured to prevent inadvertent actuation of the activation switch.

The shield member 410 also preferably includes seating flanges for providing a flush engagement with the brim surface when mounted thereto. Turning to FIG. 2, the shield member 410 includes an outer seating flange 453 adjacent the outer wall flange 454 and an inner seating flange 452 adjacent the inner wall flange 456. Each seating flange 453 and 452 is configured to sit flush with the brim surface so that the shielding member 410 can be mounted flush to the brim when the brim sleeve is secured thereto. More particularly, the outer seating flange 453 generally extends outwardly away from wall flange 454 and the inner seating flange 452 extends inwardly to the access opening 444 adjacent the inner flange wall 456.

Still referring to FIG. 2, the inner and outer seating flanges 453 and 452 are spaced apart from one another at the base of the wall 442, which help provide enhanced stability of the shield member 410 while attached to the lighted hat 404 so as to keep the shielding device adjacent to and/or surrounding the hat switch 406. The inner seated flange 452 is connected to the inner vertical flange 456 and extends annularly and in a generally parallel direction to the hat brim 414 about an inner, lower edge of the access opening adjacent the hat brim. The inner seated flange 452 may rest generally flush against the lower surface of the hat brim 414 and generally encircle the activation switch 406. The outer seated flange 453 is connected to the outer vertical flange 454 and extends annularly and in a generally parallel direction to the hat brim 414. The outer seated flange 453 may also rest generally flush against the lower surface of the hat brim 414. Moreover, at least a portion of the outer seated flange 453 may be connected to the mounting flange 443 to connect the shield member 410 to the detachable covering 408.

The preferred annular shape of the shielding member 410 and upstanding flange 441 having the distal end 445 thereof spaced beyond the switch prevent inadvertent actuation of the activation switch 406 by providing barrier wall that surrounds the switch 406 and provides an blocking surface at multiple contact locations along the annular distal end 445 against an intruding object. For example, an object having a size larger than the access opening 444 and coming in contact with the shield member/portion 410 may contact various locations along the annular distal end 445 at the same time. In one form, the intruding object may contact two opposite locations (i.e., 445*a* and 445*b* in FIG. 2) on opposite sides of the annular distal end 445 allowing the distal end 445 to support the intruding object at the two opposite locations above the activation switch 406 thereby preventing inadvertent activation of the switch 406 by the intruding object. By providing at least two points of contact, the wall 442 provides enhanced resistance from being crushed or deformed upon engaging a surface.

The guarding device 402 is advantageous because it keeps adjacent surfaces away from the power switch 406. One useful application is when a plurality of hats 404 are nested together for packaging and shipping to a store. Turning to FIG. 3, a plurality of lighted hats each having a crown 412 (not shown in FIG. 3) and a brim 414 are disposed in a nested configuration. In this example, this nested configuration includes a lower one of the lighted hats (414*a*) being nested together with an upper one of the lighted hats (411) such that the crown of the lower lighted hat is inserted into the crown of the upper light hat and the brim 414*a* of the lower lighted hat overlaps at least a portion of the brim 414 of the upper lighted hat (i.e., lower brim 414*a* overlays middle brim 414, which in turn overlays upper brim 414*b*). Each of the plurality of nested lighted hats has a spacer device in the form of the guarding device 402 mounted thereto to prevent inadvertent actuation of the activation switch 406 on each of the hat brims. As disclosed above, the guarding device 402 preferably includes the shield member 410. To provide guarding, the shield member wall 442 has a height H1 thereof that is greater than a distance the switch 406 extends beyond a surface of the brim 414 so that the distal end 445 of the shield 410 is spaced a distance H2 from the switch 406. In this manner, the guard 410 and in particular the wall 442 thereof keeps the brim 414*a* of the adjacent, lower nested hat 404*a* spaced from the activation switch 406 of the middle hat brim 411 because the shield wall 442 keeps the adjacent, nested brim 414*a* from contacting the middle hat switch 406. The height H1 of the guard wall 442 is also sufficiently high so that even if a fabric 411 covering the brim is pulled tight over the switch 406, the switch is still spaced from the top 445 of the guard wall 442.

Lighted hats may be displayed on a store shelf prior to purchasing by a consumer. Many times, a consumer may wish to test a lighted hat to evaluate how well the illumination source on the hat works. While on display, the switch access opening 444 associated with the shield member 410 provides a user with intentional and direct access to the activation switch 406. A user may therefore use a finger to directly enter the switch access opening 444 and intentionally activate the switch 406 so that the illumination or other accessory devices can be tested while the hat is displayed on the store shelf. As described above, this configuration still prevents against unintentional actuation of the activation switch while allowing a user direct access to intentionally actuate the switch. In this manner, the hat 404 can be shipped to the store with the power source 411 already installed without the concern that the activation switch be inadvertently turned on during shipment which can drain the power source thereof.

It will be understood that various changes in the details, materials, and arrangements of the parts and components that have been described and illustrated in order to explain the nature of the lighted hats and garments as claimed may be made by those skilled in the art within the principle and scope of the invention.

What is claimed is:

1. Lighted headgear comprising:

a crown to be received on a wearer's head;

a brim extending from a forward, lower edge of the crown;

at least one light source and a power source mounted to the lighted headgear for providing illumination therefrom;

a switch mounted to the brim;

a plunger actuator of the switch that extends away from the brim and which is depressible towards the brim to selectively turn the light source "on" or "off";

a packaging cover configured to be secured to the brim;

a switch guarding portion of the packaging cover for guarding the switch against unintentional activation; and a wall of the switch guarding portion arranged and configured so that with the packaging cover secured to the brim, the switch guarding portion wall is disposed adjacent the plunger actuator and extends away from the brim beyond the plunger actuator to allow for intentional and direct access to the plunger actuator by a potential purchaser and to avoid unintentional actuation of the plunger actuator.

2. The lighted headgear of claim 1, wherein the wall of the switch guarding portion adjacent the switch substantially surrounds the plunger actuator.

3. The lighted headgear of claim 2 wherein the switch guarding portion includes an access opening to provide for direct access to the plunger actuator through which a user can intentionally depress the plunger actuator.

4. The lighted headgear of claim 1, wherein the plunger actuator is on a lower surface of the headgear's brim portion and the packaging cover includes a top major portion having opposite sides and positioned to extend along an upper surface of the headgear's brim, and flap portions extending from each side of the top major portion and arranged to be folded about an outer edge of the brim to extend along an underside of the brim to position the packaging cover to conform to upper and lower surfaces of the lighted headgear brim to form a sleeve thereabout so that the packaging cover substantially maintains a profile similar to the brim.

5. The lighted headgear of claim 4, wherein each flap portion includes an extending tab arranged and configured to be inserted into an inner cavity formed by the crown so that the packaging cover can be detachably fastened to the lighted headgear in a concealed manner.

6. The lighted headgear of claim 5, wherein the tabs are overlapped and fastened to an inner sweatband extending about a lower inner surface of the crown cavity.

7. The lighted headgear of claim 1, wherein the packaging cover is a fiberboard material and the switch guarding portion is a separate piece secured to the fiberboard material.

8. The lighted headgear of claim 7, wherein the switch guarding portion includes a flange extending outwardly from an edge of the wall, the flange having a mating surface for fastening the plastic switch guarding portion to one of the fiberboard flap portions of the packaging cover.

9. The lighted headgear of claim 1, wherein the wall of the switch guarding portion has a height greater than a distance the plunger actuator extends away from the brim so that a gap is formed between the plunger actuator and an outer edge of the switch guarding wall.

10. A lighted hat comprising:

a crown portion for fitting on a wearer's head;

a brim portion generally extending forwardly from the crown portion and having upper and lower surfaces thereof;

a light source mounted to the brim portion;

an actuator for activating the light source mounted to the brim portion lower surface; and a shielding portion mounted to the brim portion adjacent the actuator to minimize unintentional engagement with the actuator and activation of the light source.

11. The lighted hat of claim 10 wherein the shielding portion is configured to extend around the actuator.

12. The lighted hat of claim 10 wherein the shielding portion has an annular configuration and extends completely around the actuator.

13. The lighted hat of claim 10 wherein the shielding portion includes an opening that allows for access to the actuator for intentional engagement therewith.

14. The lighted hat of claim 10 wherein the actuator comprises a depressible switch, and the shielding portion comprises an annular wall extending about the switch.

15. The lighted hat of claim 14 wherein the annular wall has a distal end and extends away from the brim portion lower surface to the distal end thereof, and a switch access opening at the distal end of the annular wall through which the switch can be intentionally engaged and depressed for activating the light source.

16. The lighted hat of claim 10 wherein the brim portion includes a generally rigid brim member and fabric covering the brim member with the actuator being disposed between the fabric and the brim member.

* * * * *